US007584918B1

(12) United States Patent
Briggs, Jr. et al.

(10) Patent No.: US 7,584,918 B1
(45) Date of Patent: Sep. 8, 2009

(54) WEAR PLATE ASSEMBLY FOR VERTICAL ROTOR OF A PULVERIZER

(75) Inventors: Oliver G. Briggs, Jr., Jefferson, MA (US); Christopher D. Curl, Moodus, CT (US); Thomas B. Preston, Broad Brook, CT (US); Paul C. Thulen, Granby, CT (US)

(73) Assignee: ALSTOM Technology Ltd (CH)

( * ) Notice: Subject to any disclaimer, the term of this patent is extended or adjusted under 35 U.S.C. 154(b) by 0 days.

(21) Appl. No.: 12/058,314

(22) Filed: Mar. 28, 2008

(51) Int. Cl.
*B02C 13/00* (2006.01)
*B02C 7/04* (2006.01)

(52) U.S. Cl. ..... 241/197; 241/300

(58) Field of Classification Search ..... 241/197, 241/188.1, 300
See application file for complete search history.

(56) References Cited

U.S. PATENT DOCUMENTS 2,021,762 A * 11/1935 Armour ..... 241/191
3,157,366 A * 11/1964 Rogers ..... 241/188.1
7,017,844 B1 3/2006 Racine et al.
7,028,625 B1 4/2006 Tomac
7,309,037 B2 12/2007 Schmitz et al.

OTHER PUBLICATIONS

Lin et al. Coal Pulverizer Design Upgrades to Meet the Demands of Low Nox Burners, Electric Power 2004, Mar. 30-Apr. 1, 2004, Worcester, MA.

* cited by examiner

*Primary Examiner*—Faye Francis
(74) *Attorney, Agent, or Firm*—Cantor Colburn LLP

(57) ABSTRACT

A wear plate assembly includes a body portion and an abutment flange extending from a radially outer circumferential edge of the body portion and substantially normal thereto. The abutment flange is cooperatively configured with respect to another abutment flange of a respective adjacent wear plate that interengages with the wear plate such that a convoluted edge of the another abutment flange of the respective adjacent wear plate intermeshes with a respective convoluted edge of the abutment flange of the wear plate. At least one polygonal recess and a corresponding abutment ramp are substantially aligned therewith at a same latitude on the body portion, the recess further includes a through hole extending through the wear plate. A first clip configured is partially received in the polygonal recess, the clip having a plurality of exposed impact surface faces.

15 Claims, 6 Drawing Sheets

WEAR PLATE ASSEMBLY FOR VERTICAL ROTOR OF A PULVERIZER

TECHNICAL FIELD

The present invention relates to equipment for use in a material size reduction process, and more particularly, it concerns an improved wear plate assembly for mounting in a wear protecting disposition on a rotor disc for use in a grinding chamber of a rotary coal pulverizer.

BACKGROUND

In operations that use coal for fuel, finely-ground coal particles or "fines" are required for efficient operation, yielding higher combustion efficiency than stoker firing, as well as rapid response to load changes. Using coal fines for combustion also produces less nitrous oxide ($NO_X$) emissions and keeps oversized loss-on-ignition (LOI) unburned coal particles from contaminating the marketable ash byproduct of the combustion chamber. Thus, it is common practice to supply raw coal to a device, such as a pulverizer, that will reduce the size of the coal to particles within a desirable range prior to being used for combustion.

Many pulverizers employ systems and methods including one or more crushing and grinding stages for breaking up the raw coal. For example, in a rotary pulverizer, the coal particles are reduced to dust fine enough to become airborne in an air stream swept through the pulverizer by a gradual process that includes crushing the coal by repeated crushing actions of swing hammers and grinding the coal by attrition caused by rotating elements. The dust particles are entrained in the air stream and carried out for combustion.

It should be readily apparent that the process of reducing solid coal to acceptably sized fines requires equipment and components of high strength and durability. Therefore, there exists a continuing need for components that can reduce solid coal to acceptably sized fines and yield greater overall efficiency by withstanding extremely harsh conditions and causing less operation downtime due to maintenance and repairs.

A particular type of pulverizer for size reducing solid material such as, for example, coal, comprises a raw coal inlet, a crusher dryer section, a pulverizing section, a fan section, and pulverized coal outlet. The crusher dryer section includes a plurality of beater blades all commonly mounted on a main horizontal shaft of the pulverizer, the beater blades cooperating with a grid section to effect an initial size reduction of the raw coal introduced into the pulverizer via the raw coal inlet. The pulverizing section includes a rotor disc also mounted on the main horizontal shaft for rotation thereby and a plurality of wear plate mounted on both respective axial surfaces of the rotor disc.

As the solid material is subjected to the pulverization by the pulverizing section, particles thereof cause wear and pitting of the wear plate. In addition, the particles migrate through the gaps between adjacent wear plates. These particles then cause wear and pitting of the underlying rotor disc including grooving of the rotor disc. Such wear and pitting of the rotor disc must then be remedied by removing the wear plates and costly resurfacing of the rotor disc or may even necessitate the replacement of the rotor disc before its hoped-for useful life.

However, existing technology uses wear plates that are difficult to assemble. In order to assemble the wear plates and wear components (e.g., grinding and impeller clips) to the rotor disc that make up the pulverizing section, a single person must hold together up to five individual parts, and then secure these parts with loose nuts, bolts and washers. Furthermore, existing technology uses wear components with a single wear surface, and once this single wear surface is worn, the wear component must be replaced.

Accordingly, the need still exists for an approach to controlling or limiting the migration of pulverized material through the gaps of the wear plates so as to thereby minimize wear and pitting on the underlying rotor disc. In addition, a need exists for extending component wear life, simplifying the assembly of wear plates and improving end product quality. Such an approach should preferably be inexpensive to manufacture and should be as compatible as possible with existing wear plate and rotor disc arrangements so as to facilitate the installation and use thereof. Also, the approach should be suitable for use in the relatively harsh environment of a coal pulverizing operation including being subjected to the abrasive effects of coal. The system also should be simple and reliable, in order to keep maintenance costs to a minimum.

SUMMARY

According to the aspects illustrated herein, there is provided a wear plate assembly for mounting in a wear protecting disposition on a rotor disc of a pulverizer, the rotor disc being rotatable about a rotor axis. The wear plate assembly includes: a body portion of a wear plate having a radially outer circumferential edge and a radially inner circumferential edge, an angular edge extending angularly between the radially outer circumferential edge and the radially inner circumferential edge on one side of the body portion and another angular edge extending angularly between the radially outer circumferential edge and the radially inner circumferential edge on an opposite side of the body portion, an axially inner surface disposed in facing relationship to the rotor disc in the wear protecting disposition of the wear plate on the rotor disc; an abutment flange extending from the radially outer circumferential edge of the body portion and substantially normal thereto, the abutment flange being cooperatively configured with respect to another abutment flange of a respective adjacent wear plate that interengages with the wear plate such that a convoluted edge of the another abutment flange of the respective adjacent wear plate intermeshes with a respective convoluted edge of the abutment flange of the wear plate; at least one polygonal recess and a corresponding abutment ramp substantially aligned therewith at a same latitude on the body portion, the recess further includes a through hole extending through the wear plate; and a first clip configured to be partially received in the polygonal recess, the clip having a plurality of exposed impact surface faces.

The above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION

Reference is now made to the figures and accompanying detailed description which have been provided to illustrate exemplary embodiments of the present invention, but are not intended to limit the scope of embodiments of the present invention. Although a particular type of rotary coal pulverizer is shown in the figures and discussed herein, it should be readily apparent that a device or system constructed in accordance with the present invention can be employed in a variety of other coal pulverizers, or other applications that do not involve coal as the raw material. In other words, the specific material and size reduction process is not vital to gaining the benefits associated with using a system constructed in accordance with the present invention.

Figure 1:
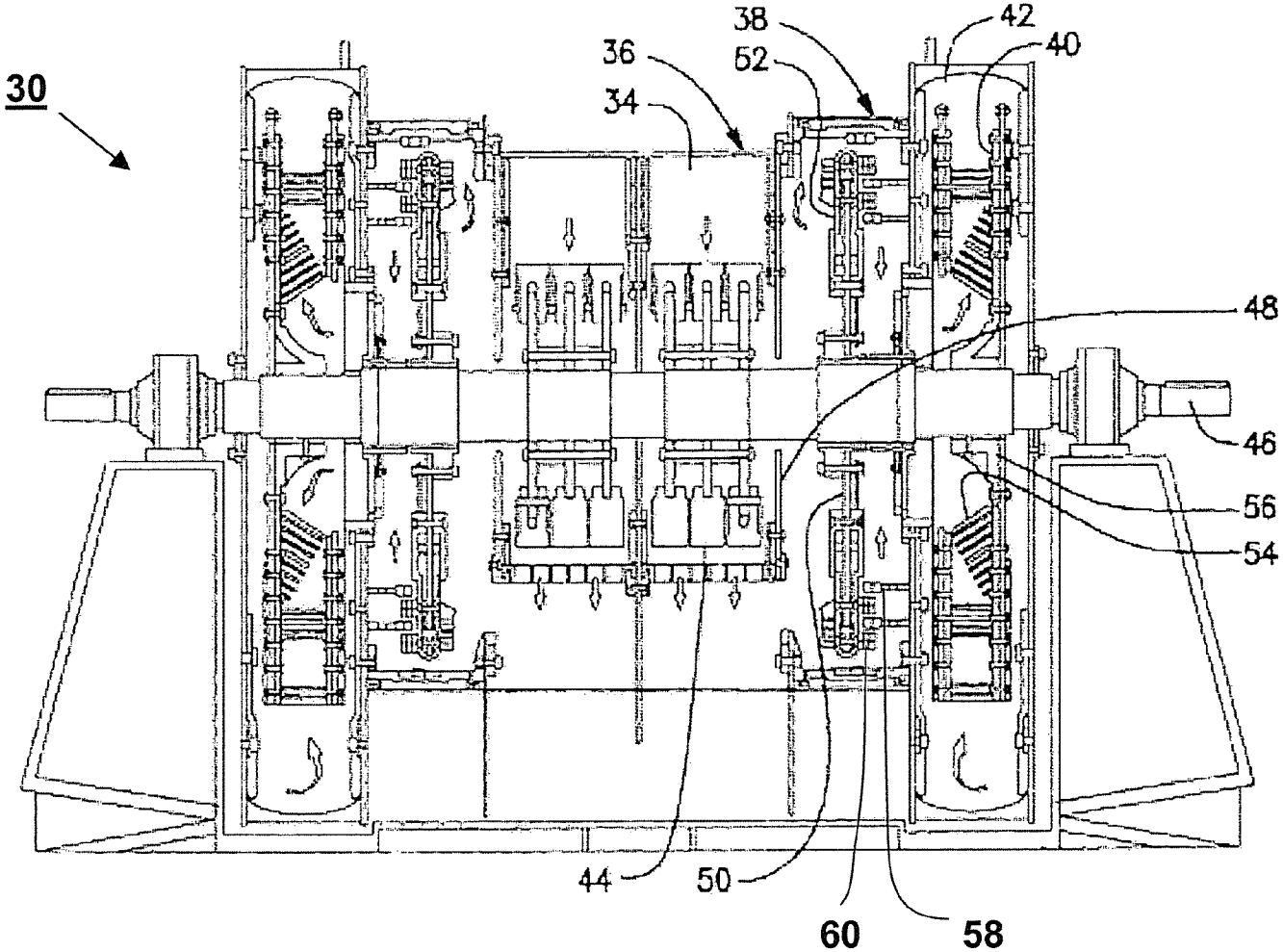
FIG. 1 is a side elevational view in partial section of a rotary coal pulverizer (duplex model) which can employ a wear plate assembly constructed in accordance with the present invention therein mounted on a center shaft at two locations.

FIG. 1 illustrates the general location of a present exemplary embodiment of a wear plate assembly (hereinafter also referred to as a "wear component") constructed in accordance with the present invention and employed in an exemplary rotary coal pulverizer 30, from the exterior of pulverizer 30. Pulverizer 30 is known as a horizontal type high speed coal mill and is closely based on a duplex model ATRITA® Pulverizer sold commercially by Babcock Power Inc. However, this should not be interpreted as limiting the present invention in any way, as many types of pulverizing devices employ similar elements and are suitable for use with the present invention.

The duplex model is essentially two single models side by side. It should be readily apparent that a wear plate assembly constructed in accordance with the present invention may also be disposed in a single model. For purposes of ease and convenience in describing the features of the present invention, only a single side of the duplex model is discussed herein.

The pulverizer 30 is a conventional horizontal shaft attrition-type pulverizer having a raw coal inlet 34, a crusher dryer section 36, a grinding section 38, a fan section 40, and a pulverized coal outlet 42. The crusher dryer section 36 includes a plurality of beater blades 44 all commonly mounted on a main horizontal shaft 46 of the pulverizer 30. The beater blades 44 cooperate with a grid section 48 to effect an initial size reduction of the raw coal introduced into the pulverizer 30 via the raw coal inlet 34. The grinding section 38 includes a rotor disc 50 also mounted on the main horizontal shaft 46 for rotation thereby and a plurality of wear plates 52 mounted on both respective axial surfaces of the rotor disc 50, as will be described in more detail shortly. The fan section 40 includes a plurality of fan vanes 54 mounted at equal angular spacings from one another around the circumference of a fan hub 56 that itself is mounted on the main horizontal shaft 46 for rotation thereby.

As can be seen in FIG. 1, pulverizer 30 consists essentially of the crusher-dryer section 36, the grinding section 38 and the fan section 40. The center shaft 46 extends through the pulverizer 30 and defines an axis of rotation. Thus, terms used herein, such as "radially outer" and "radially inner," therefore refer to the relative distance in a perpendicular direction from the axis defined by center shaft 46, while "axially inner" and "axially outer" refer to the distance along or parallel to the axis defined by center shaft 46, wherein the "axially innermost" section in pulverizer 30 is the crusher-dryer section 36.

Raw coal and primary air enter the crusher-dryer section 36. Swing hammers or beater blades 44 mounted on and driven by center shaft 46, along with impact liners (not shown), operate to crush the coal against a grid (not shown). High temperature primary air is used to flash dry any surface moisture on the coal, which helps minimize the effect of moisture on coal capacity, coal fineness, and power consumption, among other things. As the high-temperature primary air evaporates moisture from the coal, the temperature of the coal-air mixture is reduced, which significantly reduces the risk of fires within the pulverizer.

When coal passes through the grid of the crusher-dryer section 36, it enters the axially outer adjacent grinding section 38. The major grinding components in grinding section 38 include stationary pegs 58 and grinding clips 60 disposed on the rotor disc 50 mounted on the center shaft 46. As shown in FIG. 1, the pegs 58 are arranged on an interior grinding section wear plate 52 in spaced apart relationships with respect to each other. Furthermore, the pegs 58 are perpendicular with respect to the wear plate 52, and opposed to the clips 60, but are spaced so that the clips 60 and pegs 58 do not contact each other during rotation of the rotor disc 50.

The rotor disc 50 is driven by the center shaft 46, preferably at a relatively high rate of speed. The turbulent flow and impact momentum on particles, caused by the movement of the clips 60 and pegs 58, create a particle to particle attrition which further reduces the size of the coal particles received from the crusher-dryer section 36.

Figure 2:
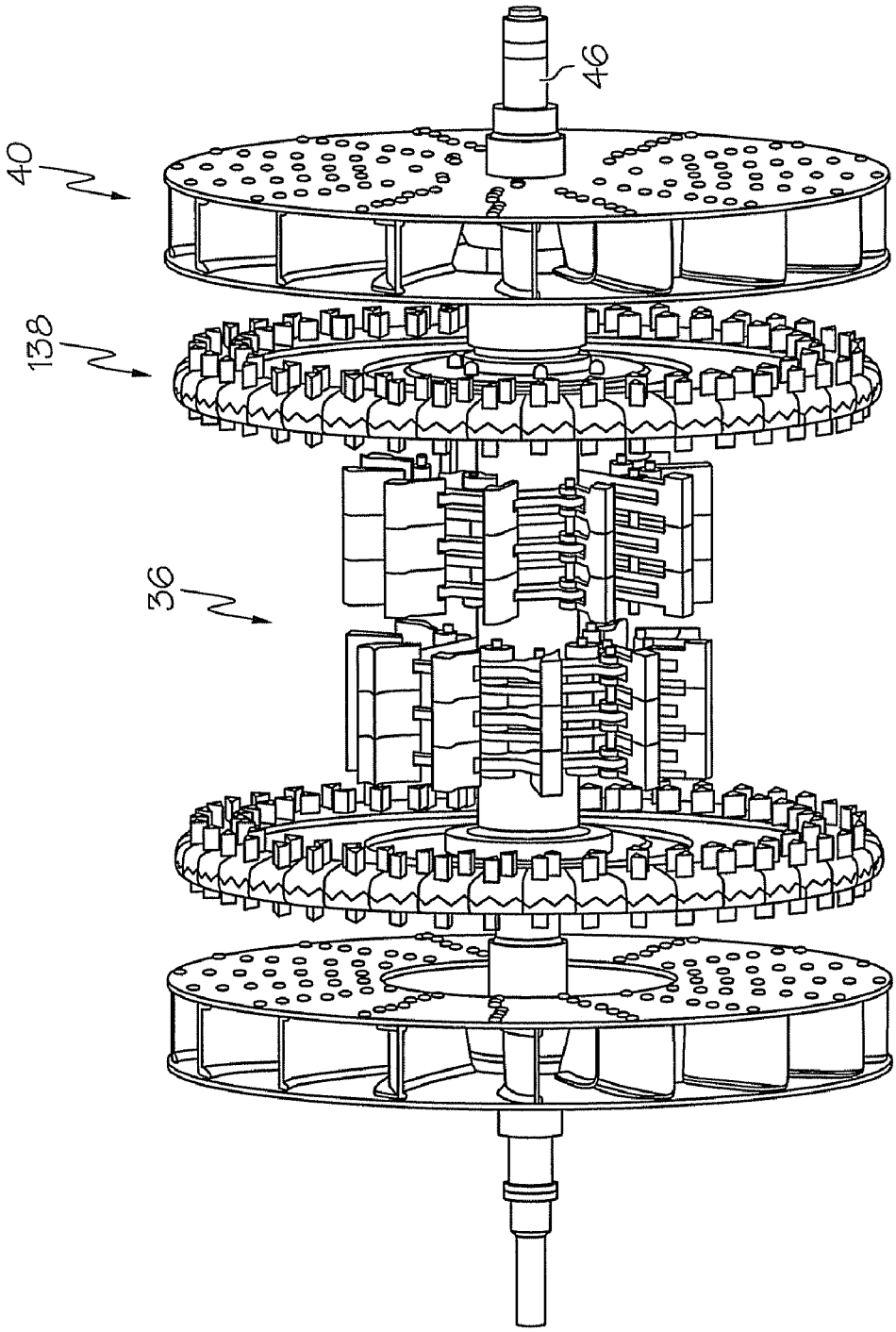
FIG. 2 is a perspective view of a center shaft removed from the pulverizer of FIG. 1 having a crusher dryer section, fan section and an exemplary embodiment of a grinding section.
Figure 4:
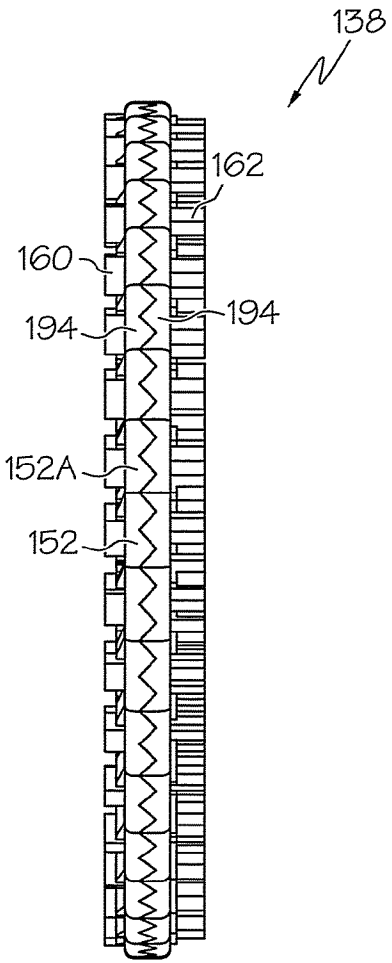
FIG. 4 is a front elevational view of the exemplary embodiment of the grinding section of FIG. 3.
Figure 3:
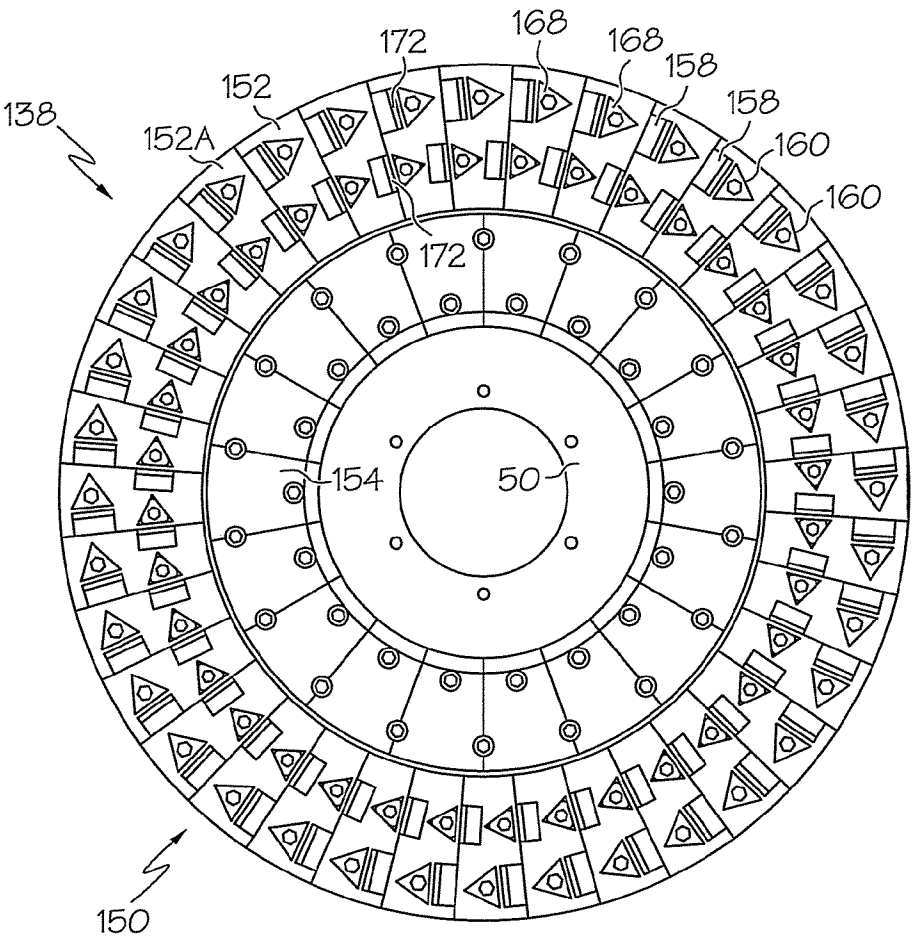
FIG. 3 is a side elevational view of the exemplary embodiment of the grinding section of FIG. 2 removed from the center shaft and having a plurality of wear plate assemblies in accordance with an embodiment of the present invention.
Figure 5:
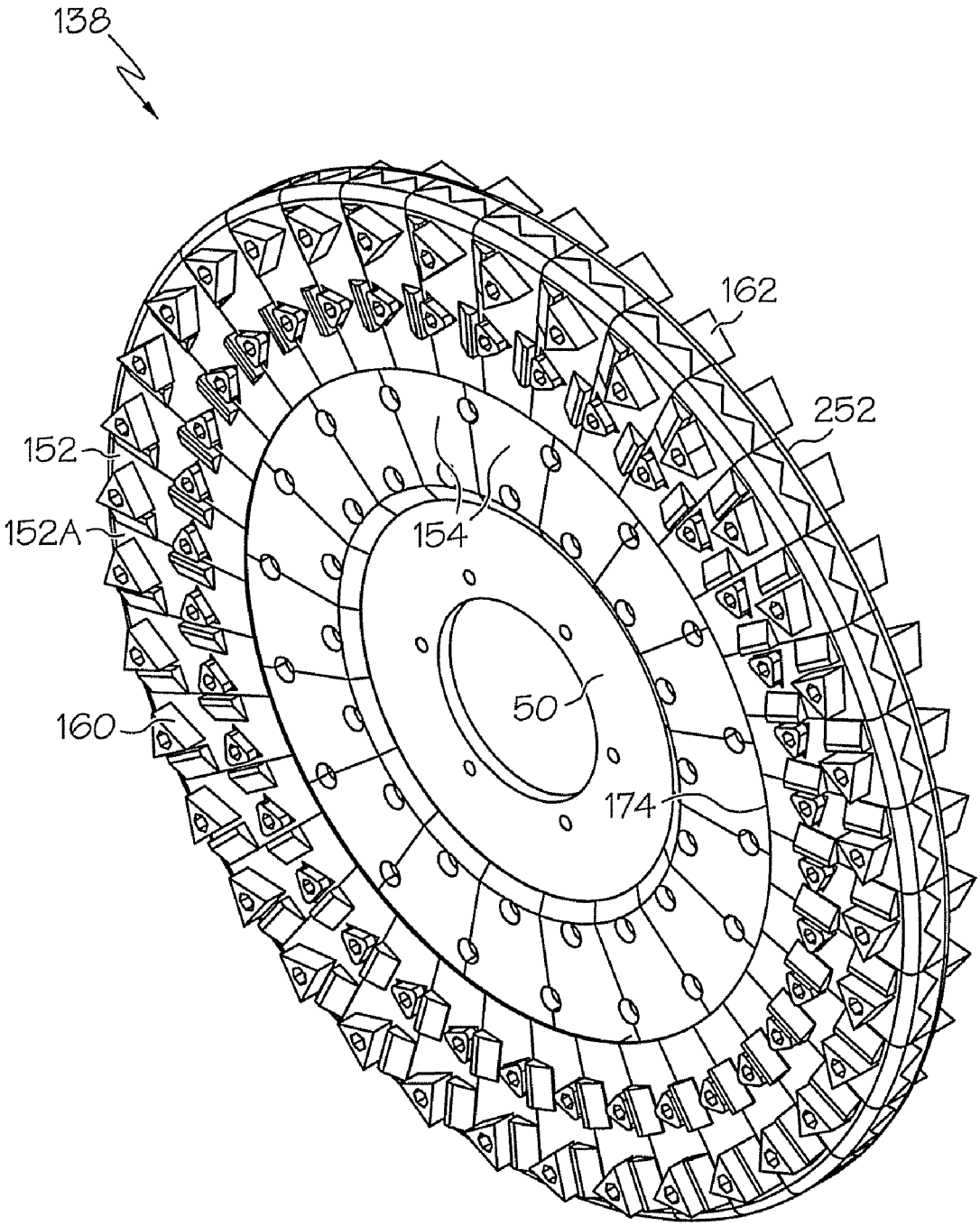
FIG. 5 is a perspective view of the exemplary embodiment of the grinding section of FIGS. 3 and 4.
Figure 6:
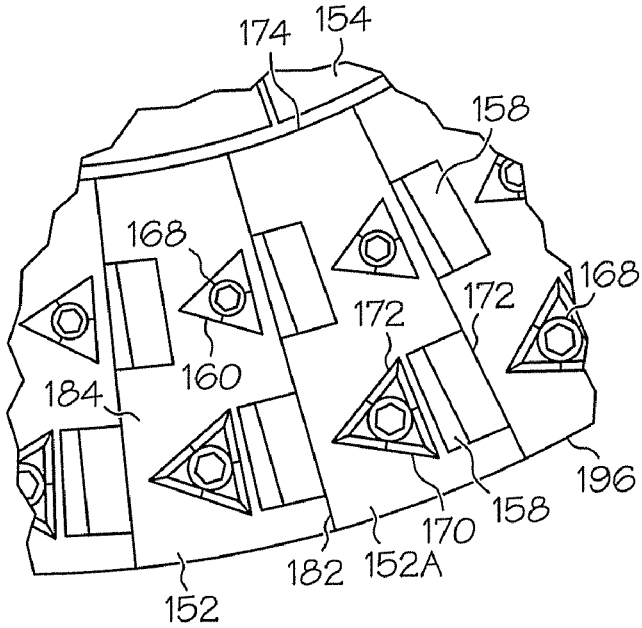
FIG. 6 is an enlarged partial view of the circled portion "A" of the grinding section in FIG. 3 illustrating a plurality of wear plate assemblies in accordance with an embodiment of the present invention.
Figure 7:
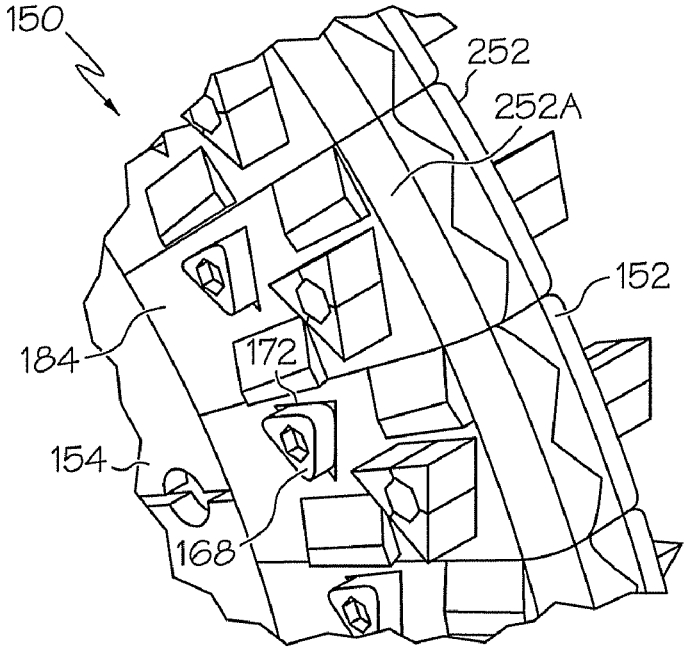
FIG. 7 is an enlarged partial view of the circled portion "B" of the grinding section in FIG. 5 illustrating a plurality of wear plate assemblies in accordance with an embodiment of the present invention.
Figure 8:
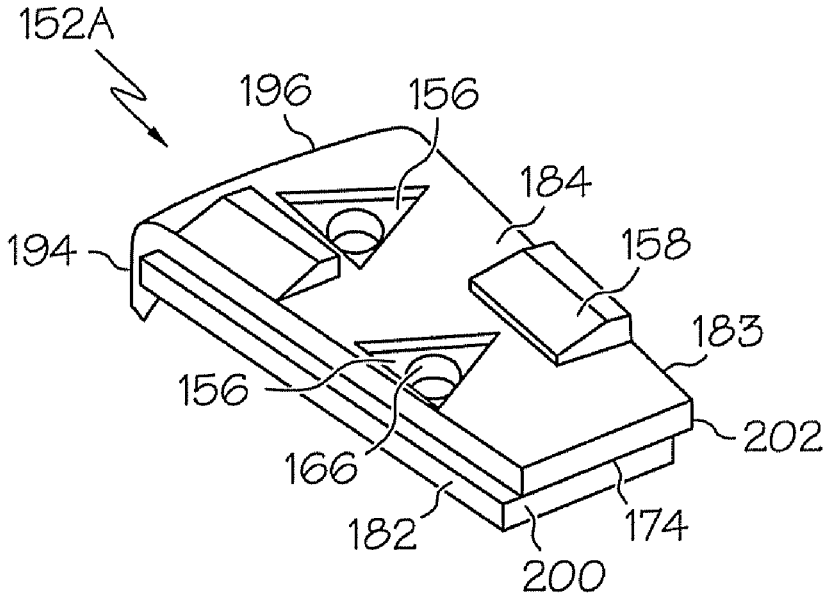
FIG. 8 is a top perspective view of a wear plate of a wear plate assembly in accordance with an embodiment of the present invention.
Figure 9:
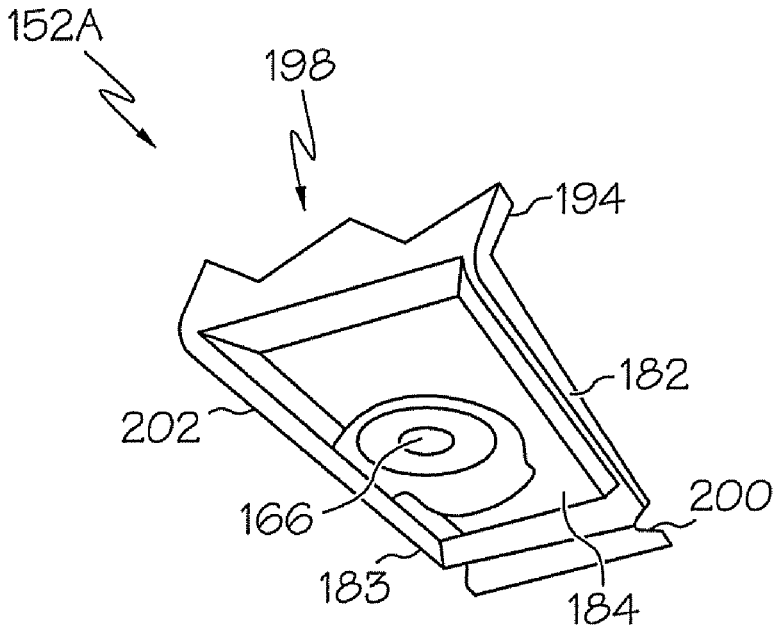
FIG. 9 is a bottom perspective view of the wear plate of FIG. 8.

FIG. 2 is a perspective view of the center shaft 46 removed from the pulverizer 30 of FIG. 1 having an exemplary embodiment of a grinding section 138. FIG. 2 also shows a rotating portion of the crusher dryer section 36 and fan section 40 of FIG. 1 mounted to the center shaft 46. FIGS. 3-5 illustrate the grinding section 138 removed from the shaft 46 in side elevation, front elevation and perspective views, respectively. FIGS. 6 and 7 are enlarged partial views of the circled portions of the grinding section in FIGS. 3 and 5, respectively, illustrating a plurality of wear plate assemblies 150 in accordance with an embodiment of the present invention. FIGS. 8 and 9 are top and bottom perspective views, respectively, of a wear plate 152 removed from the rotor disc 50 and without having a grinding or impeller clip mounted thereto in accordance with an embodiment of the present invention.

Referring to FIGS. 3-9, a plurality of inner wear plates 154 are circumferentially mounted at an intermediate portion of the rotor disc 50 and on opposing surface sides defining the rotor disc 50. A first set of the wear plate assemblies 150 are mounted on one axial side of the rotor disc 50 and a second set of the wear plate assemblies 150 are mounted on the opposite axial side of the rotor disc 50.

Each wear plate assembly 150 includes a wear plate 152 and at least one polygonal recess 156 and a corresponding abutment ramp 158 substantially aligned therewith relative to an imaginary concentric line or at substantially a same latitude, as best seen with reference to FIGS. 3 and 8. The polygonal recess 156 is configured to receive one of a grinding clip 160 or an impeller clip 162.

In exemplary embodiments, each wear plate 152 includes two recesses 156 and two corresponding abutment ramps 158. One abutment ramp 158 defines a portion of one radially extending side edge while the other abutment ramp 158 defines a portion of an opposite radially extending side edge defining each wear plate 152. Each abutment ramp 158 includes a vertical or sloping edge defining the portion of one of the radially extending side edges and a flat top section connecting the vertical and sloped edges. Moreover, each portion of the respective radially extending side edge having the abutment ramp 158 is defined by a the vertical or sloping edge, depending on which of the two radially extending side edges have the ramp 158. In other words, as best illustrated in FIGS. 7 and 8, the radially inner abutment ramp 156 of the pair of wear plates 152 includes a vertical edge defining a portion of a right side of each radially extending side edge. In contrast, the radially outer abutment ramp 156 of the pair of wear plates 152 includes a sloping edge defining a portion of a left side of each radially extending side edge.

The abutment ramp 158 is aligned with a respective clip 160, 162 to create turbulence proximate an impact surface 172 of the grinding clip 160 to facilitate attrition of the particles. The ramp 158 also blocks particles from having direct access to an interface 170 between the impact face 172 of the grinding clip 160 and a respective edge defining the recess 156 (FIG. 6). In this manner, the ramp 158 eliminates or effectively reduces the amount of particles that may collect in the interface 170 between the impact face 172 of the grinding clip 160 and a respective edge of the three edges defining the recess 156.

It will be recognized by those skilled in the pertinent art that the impact face 172 of the grinding clip 160 corresponds to a face of the clip 160 that impacts the particle due to rotation of the rotor disc 50 in a counterclockwise direction indicated in FIG. 3. It will be further recognized that the grinding clips 160 are disposed on a "first effect side" and the impeller clips 162 are disposed on a "second effect side" due to the coal flow direction indicated in FIG. 4.

In an exemplary embodiment, the polygonal recess 156 is three-sided (e.g., shaped as a triangular recess) to receive a complementary shaped triangular grinding clip 160 or impeller clip 162. However, it is contemplated that the polygonal recess and respective clip 160, 162 may have two or more sides, in alternative exemplary embodiments.

The recess 156 further includes a through hole 166 extending through the wear plate 152 to receive a mechanical fastener 168 therethrough. In an exemplary embodiment, as illustrated in FIGS. 3 and 5-7, the mechanical fastener 168 includes a securement bolt 168 extending through one of the grinding or impeller clips 160, 162 to secure the clip in the respective recess 156 and extends through a first wear plate 152 on one side of the rotor disc 50 to extend through another recess 156 of a second wear plate 252 on an opposite side of the rotor disc 50. The bolt 168 then secures another clip 162, 160 opposite to the clip 160,162 on the second wear plate 252. The bolt 168 may either thread directly into a threaded clip 162, 160 or be secured with a nut (not shown). In this manner, one mechanical fastener 168 retains two clips to respective wear plates 152, 252 and clamps the pair of wear plates 152, 252 to the rotor disc 50.

The wear plates 152 extend radially outwardly to the inner wear plates 154. In particular, an outer circumferential edge of the inner wear plates 154 abut an inner arcuate edge 174 of the wear plates 152. The wear plates 152 are configured such that wear plates 152, 252 on the first and second effect outer sections are interchangeable. In addition, all wear plates 152, 252 are configured in matched weight pairs to ensure proper balance.

The wear plates 152, 252 are configured to each provide wear-protecting coverage of a predetermined arcuate extent of the rotor disc 50—namely, a wear-protecting coverage of an arcuate extent of between nine to ten degrees (9° to 10°). The radially extending side edges of each wear plate 152, 252 are specifically configured in accordance with the present invention to engage the mutually facing radially extending side edge of the respective adjacent wear plate 152, 252 so as to advantageously minimize the detrimental effects of the migration of coal particles between adjacent wear plates 152, 252. As seen in FIGS. 8 and 9, and described in U.S. Pat. No. 7,017,844, within a given set of wear plates 152 that provide wear-protecting coverage to a respective axial side of the rotor disc 50, the same respective left- or right-handed side edges of the wear plates 152 of the given set of wear plates 152 are identically configured while the other respective left- or right-handed side edges of the wear plates 152 of the given set of wear plates 152 are identically configured with one another.

Moreover, the left-hand side edges of the wear plates 152 of each given set of wear plates 152 are configured in correspondence with the right-hand side edges of the wear plates 152 of the same given set of wear plates 152 so as to yield a desirable interengagement between each pair of a side edge of a wear plate 152 and the mutually facing side edge of an adjacent wear plate 152 when the set of wear plates 152 are mounted on the one respective axial side of the rotor disc 50. In other words, adjacent wear plates are "ship lapped" with respect to one another.

FIGS. 4-7 illustrate the right-hand side edge of one of the wear plates 152 mounted on one axial side of the rotor disc 50, hereinafter designated as the wear plate 152A. FIGS. 8 and 9 illustrate the wear plate 152A removed from the rotor 50. This right-hand side edge of this wear plate 152A, hereinafter designated as the right-hand side edge 182, is, in accordance with an embodiment of the present invention, correspondingly configured with respect to the left-hand side edges 183 of the wear plates 152 of the respective set of wear plates 152 mounted on this one axial side of the rotor disc 50. The wear plate 152A, which is shown in its rotor disc-mounted disposition in FIGS. 4-7, which illustrates the wear plate 152A as previously installed by hand into its corresponding side edge engagements with the respective pair of the wear plates 152 adjacent to the wear plate 152A.

The wear plate 152A includes a body portion 184 having the pair of recesses 156 and corresponding abutment shoulders 158. The placement of the wear plate 152A onto the one axial side of the rotor disc 50 during the installation process brings each of the recesses 156 of the wear plate 152A into registry with an underlying bore (not shown) in the rotor disc 50 such that a respective securement bolt 168 can be extended through each respective pair of clips 160, 162 and each respective pair of aligned bores and secured with a nut (not shown) or one of the clips 160, 162 being threaded.

The wear plate 152A also includes an abutment flange 194, as best seen with reference to FIG. 9, that extends from a radially outer circumferential edge 196 defining each wear plate 152 and 152A. The abutment flange 194 further has a terminal edge defining a convoluted edge 198 such that the convoluted edge 198 in non-coplanar. In an exemplary embodiment, the convoluted edge is configured having a saw tooth profile, but is not limited thereto, as the profile may be rounded, for example. The convoluted edge 198 on one wear plate 152 on one axial side of the rotor 50 intermeshes with the convoluted edge 198 of corresponding wear plate 152 on an opposite axial side of the rotor 50, as best seen with reference to FIGS. 4 and 7. The intermeshing of the nonlinear edge defined by joining respective radially outer circumferential edges 196 of opposing wear plates 152 helps to eliminate or effectively reduce particles from emanating therethrough the abutting edges 196 to protect the integrity of the rotor 50 lying therebeneath. The body portion 184 of the wear plates 152 and 152 has an overall shape, as viewed proximate the radially outer circumferential edge 196 of the wear plates 152 and 152A , whereat the body portion 184 has an overall curved hook shape terminating at the convoluted edge 198 of the wear plates 152 and 152A. The radially inner surface of the body portion 184 of the wear plates 152 and 152A—that is, the surface of the body portion 184 that is in facing relation to the rotor disc 50—is a generally planar surface.

The wear plate 152A further includes an underlap flange 200 that extends in its length dimension from the radially outer circumferential edge 196 of the wear plates 152, 152A to its radially inner circumferential edge 174. The underlap flange 200 has a thickness less than the thickness of a major portion of the body portion 184.

The underlap flange 200 of the wear plate 152A is cooperatively configured with respect to an overlap rim 202 of the respective adjacent wear plate 152 that is in interengagement with the right-hand edge of the wear plate 152A. The wear plate 152A has, as do all of the wear plates 152, an overlap rim 202 on its left-hand edge. With reference to FIGS. 8 and 9, it can be seen that the overlap rim 202 on the left-hand edge (FIG. 8) of each wear plate 152 has an axially inner surface whose curvature tracks the curvature of the axially outer surface of the underlap flange 200 of the adjacent wear plate. Apart from the overlap rim 202, the left hand edge of each wear plate 152 has a planar face extending from the radially outer circumferential edge 196 of the wear plate 152 to its radially inner circumferential edge 174. Accordingly, the underlap flange 200 of the wear plate 152A can be inserted into the clearance between the overlap rim 202 of the respective adjacent wear plate 152 and the rotor disc 50 during mounting of the wear plate 152A on the rotor disc 50 such that the overlap rim 202 of the respective adjacent wear plate 152 at least partially overlaps the underlap flange 200 of the wear plate 152A—i.e., the overlap rim 202 of the respective adjacent wear plate 152 is axially outward of, and angularly coincident with, a portion of the underlap flange 200 of the wear plate 152A.

In exemplary embodiments, the clips 160 and 162 are protected with brazed tungsten carbide tiles or cladding (both not shown) for impact resistance and wear. Further, as described above, the wear plates 152, 152A having recesses 156 to receive the clips 160, 162 and corresponding through holes in conjunction with an impact face 172 disposed on multiple lateral surfaces defining the exemplary grinding and impeller clips 160 and 162, respectively, facilitate assembly of the wear plates to a rotor disc 50 and extend the lifetime of the clips 160, 162 by rotation of the same within a respective recess 156.

Further, the clips 160, 162 having multiple impact faces 172 corresponding to the respective multiple edges defining each recess 166 enable the clips to be repositioned for the purpose of extending the lifetime of the clip before changing the clip and for enhancing particle size reduction, as will be recognized by those skilled in the pertinent art. In particular, the clip 160, 162 may be repositioned to change the impact face 172 facing the particles during rotation of the rotor 50 before having to change the clip 160, 162 completely, in order to extend the life of the clip and/or enhance particle size reduction. The lifetime of each clip can be extended by as many times corresponding to the number of impact faces 172 defining each clip 160, 162 (e.g., triangular shaped clip having three faces can have three positions extending the lifetime three times over a single impact face clip). Moreover, the clip 160, 162 may be changed or repositioned without having to remove the wear plate 152 from the rotor 50. In addition, the use of a single securement bolt to secure a pair of wear plates and pair of clips to the rotor disc reduces the overall parts count for such a wear plate assembly.

It will be easily recognized by those skilled in the pertinent art that above described wear plate assembly provides a customer with hardware more robust than the present day offering. Further, it is known that all hardware in the field environment where this equipment lives requires maintenance at one time or another. The new, novel configured exemplary wear plate assembly is designed to give the customer more user-friendly hardware to disassemble and assemble when the occasion does arise requiring parts cleaning or replacement. In particular, the exemplary wear plate assembly reduces the costly need to rebuild or weld repair the underlying grinding rotor disc and is a direct replacement to the original first or second effect wear plate. The exemplary wear plate assembly provides a unique component fit-up where the rotor disc is protected by ship lapped wear plates and opposing wear plates on either side of the rotor disc are convoluted on the rotor disk edge for better protection of the base material defining the rotor disk.

The exemplary wear plate assembly provides mid life component orientation adjustment, which extends operation of the pulverizer before component replacement is necessary and provides longer operation between outages. In addition, multi-impact faces for the clips provides an adjustable grinding surface, which results in a "likely" improvement in coal fineness, thus improving ash sales, heat rate, NOx, and slagging, for example, but is not limited thereto.

Lastly, the simplified fastening system of the exemplary wear plate assembly offers simplified and less strenuous installation with improved part fit-up resulting in shorter outage time and eliminates or effectively reduces part fit-up issues.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A wear plate assembly for mounting in a wear protecting disposition on a rotor disc of a pulverizer, the rotor disc being rotatable about a rotor axis, the wear plate assembly comprising:

a body portion of a wear plate having a radially outer circumferential edge and a radially inner circumferential edge, an angular edge extending angularly between the radially outer circumferential edge and the radially inner circumferential edge on one side of the body portion and another angular edge extending angularly between the radially outer circumferential edge and the radially inner circumferential edge on an opposite side of the body portion, an axially inner surface disposed in facing relationship to the rotor disc in the wear protecting disposition of the wear plate on the rotor disc;

an abutment flange extending from the radially outer circumferential edge of the body portion and substantially normal thereto, the abutment flange being cooperatively configured with respect to another abutment flange of a respective adjacent wear plate that interengages with the wear plate such that a convoluted edge of the another abutment flange of the respective adjacent wear plate intermeshes with a respective convoluted edge of the abutment flange of the wear plate;

at least one polygonal recess and a corresponding abutment ramp substantially aligned therewith at a same latitude on the body portion, the recess further includes a through hole extending through the wear plate; and a first clip configured to be partially received in the polygonal recess, the clip having a plurality of exposed impact surface faces.

2. The wear plate assembly according to claim 1, further comprising:

a mechanical fastener extending through the first clip and through hole in the polygonal recess for registry with an underlying bore in the rotor disc such that the securement bolt can be extended through holes of facing wear plates on either side of the rotor disc securing a second clip opposite the first clip.

3. The wear plate assembly according to claim 2, wherein the mechanical fastener retains the first and second clips to respective wear plates and clamps the pair of wear plates to the rotor disc.

4. The wear plate assembly according to claim 3, wherein the mechanical fastener includes a securement bolt extending through the first clip to secure the first clip in the respective recess and extends through the wear plate on one side of the rotor disc to extend through another recess on the facing wear plate on an opposite side of the rotor disc to secure the second clip in a respective recess.

5. The wear plate assembly according to claim 4, wherein the bolt may either thread directly into the second clip or be secured with a nut.

6. The wear plate assembly according to claim 2, wherein the first clip is one of a grinding clip or an impeller clip and the second clip is one of an impeller clip or a grinding clip, respectively.

7. The wear plate assembly according to claim 2, wherein each wear plate includes two recesses and two corresponding abutment ramps.

8. The wear plate assembly according to claim 7, wherein one abutment ramp defines a portion of one radially extending side edge while the other abutment ramp defines a portion of an opposite radially extending side edge defining each wear plate.

9. The wear plate assembly according to claim 8, wherein each abutment ramp includes a vertical or sloping edge defining the portion of one of the radially extending side edges and a flat top section connecting the vertical and sloped edges.

10. The wear plate assembly according to claim 9, wherein each portion of the respective radially extending side edge having a respective abutment ramp is defined by the vertical or sloping edge, depending on which of the two radially extending side edges have the ramp.

11. The wear plate assembly according to claim 1, wherein the polygonal recess is three-sided and shaped as a triangular recess to receive a complementary shaped triangular clip.

12. The wear plate assembly according to claim 1, wherein each wear plate is configured such that a plurality of wear plates on the first and second effect outer sections are interchangeable.

13. The wear plate assembly according to claim 1, wherein the radially extending side edges of each wear plate are specifically configured to engage mutually facing radially extending side edge of the respective adjacent wear plate so as to advantageously minimize the migration of coal particles between adjacent wear plates.

14. The wear plate assembly according to claim 1, wherein the first clip includes brazed tungsten carbide tiles for impact resistance and wear.

15. The wear plate assembly according to claim 1, wherein each of the plurality of exposed impact surface faces is repositionable within the recess to expose a different impact surface face relative to a direction of rotation of the rotor disc for at least one of extending a lifetime of the clip and enhancing particle size reduction.

* * * * *